United States Patent [19]

Ohri et al.

[11] Patent Number: 5,027,053

[45] Date of Patent: Jun. 25, 1991

[54] LOW POWER $V_{CC}/2$ GENERATOR

[75] Inventors: Kul B. Ohri; Wen-Foo Chern, both of Boise, Id.

[73] Assignee: Micron Technology, Inc., Boise, Id.

[21] Appl. No.: 575,050

[22] Filed: Aug. 29, 1990

[51] Int. Cl.[5] ..... G05F 3/24

[52] U.S. Cl. ..... 323/314; 323/313; 307/296.8

[58] Field of Search ..... 323/312, 313, 314, 315, 323/316; 307/296.1, 296.2, 296.5, 296.6, 296.8

[56] References Cited

U.S. PATENT DOCUMENTS 4,260,946 4/1981 Wheatley, Jr. ..... 323/314
4,906,914 3/1990 Ohsawa ..... 323/314
4,931,718 6/1990 Zitta ..... 323/313

*Primary Examiner*—Peter S. Wong
*Attorney, Agent, or Firm*—David J. Paul; Stanley N. Protigal

[57] ABSTRACT

A CMOS intermediate potential generation circuit having a voltage reference state, an intermediate comparator stage and an output stage. The intermediate potential is also used as feedback to the comparator stage. The inventive circuit is characterized by low standby current consumption, quick correction to deviations in the output voltage due to load variations, and quick response to generate a new intermediate potential relative to transitions of voltage supplies.

2 Claims, 3 Drawing Sheets

LOW POWER $V_{CC}/2$ GENERATOR

BACKGROUND OF THE INVENTION

1. Field of the Invention

This invention relates to a CMOS intermediate potential generation circuit formed in a semiconductor integrated circuit (IC). The inventive circuit generates a low power intermediate potential from a power source voltage supplied to the device.

2. Background of the Invention

The invention uses various materials which are electrically either conductive, insulating or semiconducting, although the completed semiconductor circuit device itself is usually referred to as a "semiconductor". The invention refers to a method of controlling addressed devices, and is not restricted to implementations which involve memory devices or semiconductor devices.

In an integrated circuit (IC) device, it is often useful to have a potential that is at some intermediate value between the supply potentials to the IC. Many different kinds of circuits have been developed to generate intermediate potentials.

FIG. 1 shows perhaps the simplest way to generate an intermediate potential. Two resistors R1 and R2 are connected in series from a potential supply $V_{cc}$ to a lower supply potential $V_{ss}$. The voltage available between the two resistors is the intermediate potential. This circuit, known as a resistive voltage divider, has a disadvantage of consuming excessive amounts of supply current.

FIG. 2 shows another kind of intermediate potential generation circuit, developed by Okada, et al., U.S. Pat. No. 4,663,584, hereby incorporated by reference. A notable feature of this circuit is that transistors Q3 and Q4 drive intermediate potential $V_{02}$ only when V02 strays from a predetermined value. The chain from VCC to $V_{22}$ formed by R3, Q1, Q2 and R4 require minimal standby current. In this manner, an intermediate potential with a much higher drive is obtained, while consuming only enough supply current to generate a reference voltage and to adjust $V_{02}$ when it strays from the desired potential.

FIG. 3 shows a similar circuit, determined by reverse engineering a device made by Hitachi, Ltd., of Tokyo, Japan, which has Okada's minimal standby current advantage along with the added advantage of quicker response time in V03 to VCC transitions. The circuit of FIG. 3 accomplished this speed improvement by replacing resistors R3 and R4 of FIG. 2 with transistors Q5 and Q6 gated by node VX3 as shown in FIG. 3. For example, if $V_{cc}$ undergoes a positive transition, the difference between VX3 and the rising $V_{cc}$ causes Q5 to turn on harder than normal. Node V1 is pulled up which turns on transistor Q3, which in turn pulls up node V03. When VX3 stabilizes to $V_{cc}/2$, Q3 turns off and V03 stabilizes to the new $V_{cc}/2$. Similarly, node V03 is pulled down by Q4 when $V_{cc}$ undergoes a negative transition.

An intermediate potential generation circuit is desired that can provide faster response to load variations and supply voltage transitions, higher current drive, and lower standby current than the circuits of FIGS. 2 and 3.

SUMMARY OF THE INVENTION

A low power $V_{cc}/2$ generation circuit utilizes the major advantages of low power consumption along with extremely quick response time to tracking $V_{cc}$ by switching p-channel and n-channel drive transistors. The circuit also has a major added feature of providing large current drive to the intermediate stages.

This intermediate potential generation circuit not only responds quickly to changes in $V_{cc}$ than does the circuit of FIG. 3 and consumes less standby current than any of the circuits of FIGS. 1, 2, and 3, but also has a large current drive capability to intermediate stages by the presence of preamplifiers used as voltage comparators.

DETAILED DESCRIPTION OF THE PREFERRED EMBODIMENT

Figure 2:
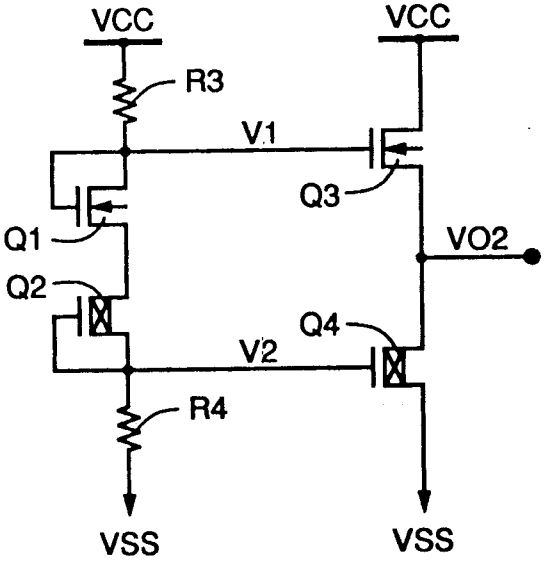
FIG. 2 (PRIOR ART)
FIG. 2 shows a prior art intermediate potential generation circuit, which offers the improvement of less supply current consumption over the resistor network of FIG. 1.
Figure 3:
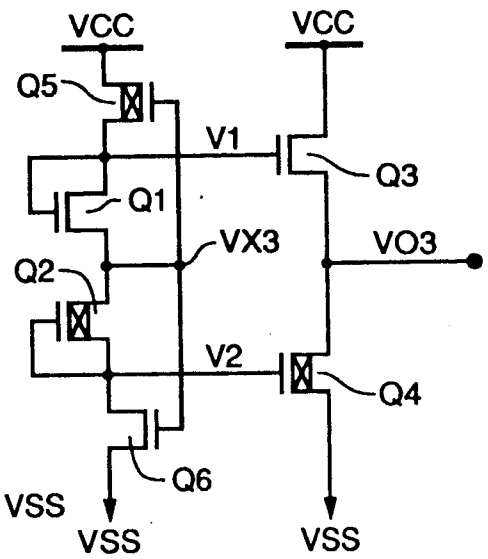
FIG. 3 (PRIOR ART)
FIG. 3 shows yet another prior art intermediate potential generation circuit, which has the advantage of more quickly responding to changes in $V_{cc}$ than the circuit of FIG. 2.
Figure 1:
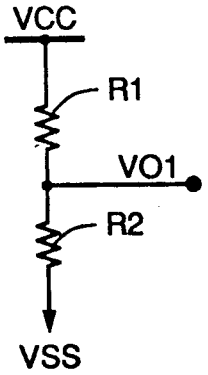
FIG. 1 (PRIOR ART)
FIG. 1 shows a simple prior art resistive voltage divider, which consumes a significant amount of supply current.
Figure 4:
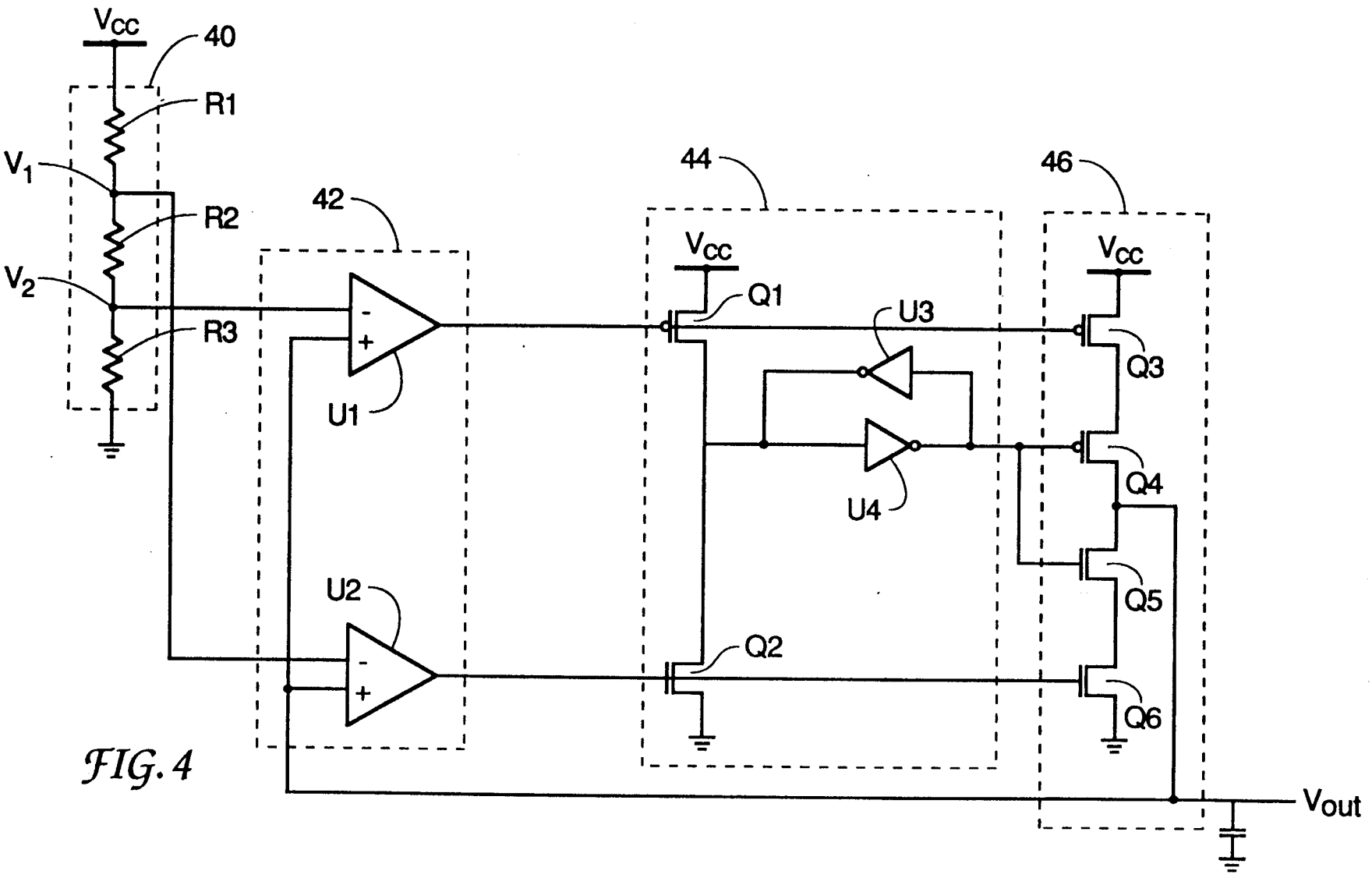
FIG. 4 depicts an embodiment of the invention in which an intermediate potential generation circuit is provided.

As shown in FIG. 4, a preferred embodiment of the invention includes a reference circuit 40, a comparator stage 42, an intermediate stage 44, and an output stage 46.

Reference circuit 40 consists of voltage divider R1, R2, and R3 connected in series between voltage supplies $V_{cc}$ and $V_{ss}$ ( which is usually at zero or ground potential). The series resistance combination of R1, R2, and R3 is such that reference voltages V1 of 2.6V and V2 of 2.4V when $V_{cc}$ is 5V. V1 and V2 are provided to comparator stage 42 at the negative input terminals of operational amplifiers (op amps) U1 and U2, respectively. The reference voltages V1 and V2 vary linearly with variations in $V_{cc}$.

Op amps U1 and U2 respond according to voltage $V_{OUT}$ presented to their positive input terminals which is supplied by series output stage 46 connected between $V_{cc}$ and $V_{ss}$ consisting of p-channel transistors Q3 and Q4 with n-channel transistors Q5 and Q6. The output terminal of U1 provides drive to the input gates of p-channel transistors Q1 and Q3, while U2 provides drive to the input gates of n-channel transistors Q2 and Q6.

Intermediate stage 44 consists of transistors Q1 and Q2 and inverters U3 and U4. Q1 and Q2 are connected in series between $V_{cc}$ and $V_{ss}$ with the source terminal of Q1 coupled to $V_{cc}$ and the drain terminal of Q1 coupled to the source terminal of Q2, the input terminal of U4 and the output terminal of U3. Completing the series connections, the drain terminal of Q2 is coupled to $V_{ss}$.

The intermediate stage 44 operates in a Schmitt trigger mode (or a simple latching network) by the coupling arrangement of U3 and U4 which virtually eliminates any output current transients generated when output drive of stage 44 switches between Q1 and Q2. U3 and U4 function as a simple latch network by the coupling of the output terminal of U3 to the input terminal of U4, while the output terminal of U4 is coupled to the input terminal of U3. The output terminal of U4 provides drive to the gates of output drive transistors Q4 and Q5. Output stage 48 has the source terminal of Q3 coupled to $V_{cc}$ with its drain terminal connected to the source terminal of Q4. The coupling between source terminal Q4 and source terminal Q5 provides intermediate voltage potential $V_{OUT}$ which also feeds back to the positive terminals of comparator stage 42, as mentioned earlier. Completing the series circuit of output stage 46, the drain terminal of Q5 is coupled to the source terminal of Q6 and finally, the drain terminal of Q6 is coupled to $V_{ss}$.

For a general understanding of circuit operation assume for sake of illustration that the threshold voltage for all n-channel and p-channel devices are approximately equal to 1V and function as switches. Further assume that series transistors in their respective stages are matched. Further assume that $V_{cc}$ is 5.0V and $V_{ss}$ is 0V in an ideal state.

A "correction" occurs when variations in a load driven by $V_{OUT}$ forces $V_{OUT}$ to deviate from its voltage reference level with the inventive circuit compensating by urging $V_{OUT}$ back to its correct level.

A "response" occurs when $V_{cc}$ or $V_{ss}$ undergoes a transition to a new voltage level and the inventive circuit generates a corresponding new reference voltage level for $V_{OUT}$.

CORRECTIONS TO $V_{OUT}$ TRANSITIONS

In an ideal state V1 stabilizes at 2.6V and V2 stabilizes at 2.4V supplying reference voltages to the negative input terminals of U1 and U2, respectively. Depending on the load presented to the output, $V_{OUT}$ will be in one of the following three conditions:

Condition 1, $V_{OUT}$ is less than 2.4V.

Condition 2, $V_{OUT}$ is greater than 2.4V but less than 2.6V.

Condition 3, $V_{OUT}$ is greater than 2.6V.

When the circuit operates in the condition 1 mode, $V_{OUT}$ of less than 2.4V is presented to the positive terminals of comparators U1 and U2. Due to the reference voltage at the negative terminals, the outputs of U1 and U2 drive negative. With a negative voltage presented to the gates of PMOS transistors Q1 and Q3 each transistor's threshold voltage of −1V is overcome, thus turning on both transistors that in turn couple $V_{cc}$ (defined as a one) from their source terminals to their respective drain terminals. With a negative voltage presented to the gates of NMOS transistors Q2 and Q6, each transistor's threshold voltage of 1V is overcome, thus turning off both transistors and not allowing a path for current flow.

From the results of circuit response between Q1 and Q2, a one is present at the input terminal of inverter U4 causing U4 to drive a low voltage (defined as a zero) to its output terminal, to the input terminal of U3 and to the gates of transistors Q4 and Q5. The zero now present at U3's input causes U3 to drive a one to its output terminal, thus reinforcing the one already present at U4's input terminal and causing U3 and U4 to operate as a simple latch.

With a zero present at the gates of Q4 and Q5, Q4's threshold voltage of −1V is overcome, turning Q4 on, while Q5's threshold voltage of 1V is not overcome, turning Q5 off. Now with Q3 and Q4 in the on state a current path is provide from $V_{cc}$ to drive a load presented to $V_{OUT}$. As long as the load does not change, the circuit will begin to operate in the condition 2 mode in order to stabilize $V_{OUT}$ between V1 and V2.

When the circuit operates in the condition 2 mode, a $V_{OUT}$ greater than 2.4V but less than 2.6V is presented to the positive terminals of comparators U1 and U2. Due to reference voltages V1 and V2, present at the negative terminals of stage 42, U1 drives its output positive while U2 drives its output negative. With a positive voltage presented to the gates of PMOS transistors Q1 and Q3 each transistor's threshold voltage of −1V cannot be overcome, thus turning off both transistors. Since U2 is in the same state it was in condition 1 the analysis remains the same as Q2 and Q6 remain off preventing a current path to ground through these transistors. From the results of Q1, Q2, Q3 and Q5 being off, the desired level of $V_{cc}/2$ for $V_{OUT}$, ranging between 2.4V and 2.6V, is maintained as the load remains constant.

When the circuit operates in the condition 3 mode, a $V_{OUT}$ greater than 2.6V is presented to the positive terminals of comparators U1 and U2. Due to the reference voltages V1 and V2 present at the negative terminals of stage 42, both U1 and U2 drive their outputs positive. With a positive voltage presented to the gates of PMOS transistors Q1 and Q3 each transistor's threshold voltage of −1V is not overcome, thus turning off both transistors. With a positive voltage presented to the gates of NMOS transistors Q2 and Q6, each transistor's threshold voltage of 1V is overcome, thus turning on both transistors and pulling their respective source terminals to ground.

From the results of Q2 pulling its output terminal to ground (defined as zero), a zero is present at the input terminal of inverter U4 causing U4 to drive a high voltage to its output terminal, to the input terminal of U3 and to the gates of transistors Q4 and Q5. The one now present at U3's input causes U3 to drive a zero to its output terminal, thus reinforcing the zero already present at U4's input terminal.

With a one present at the gates of Q4 and Q5, Q4's threshold voltage of −1V is not overcome turning it off while Q5's threshold voltage of 1V is overcome turning it on. Now with Q5 and Q6 in the on state, a current path is provide from $V_{OUT}$ to ground. As long as the load does not change, the circuit will again operate in the condition 2 mode and stabilize $V_{OUT}$ between 2.4 and 2.6V.

It should be understood that the voltage reference levels and the corresponding $V_{OUT}$ voltage levels described in the three conditions described earlier depend directly on the voltage level of $V_{cc}$. The same scenario of conditions one through three results from different levels of $V_{cc}$.

RESPONSES TO $V_{cc}$ TRANSITIONS

Figure 5:
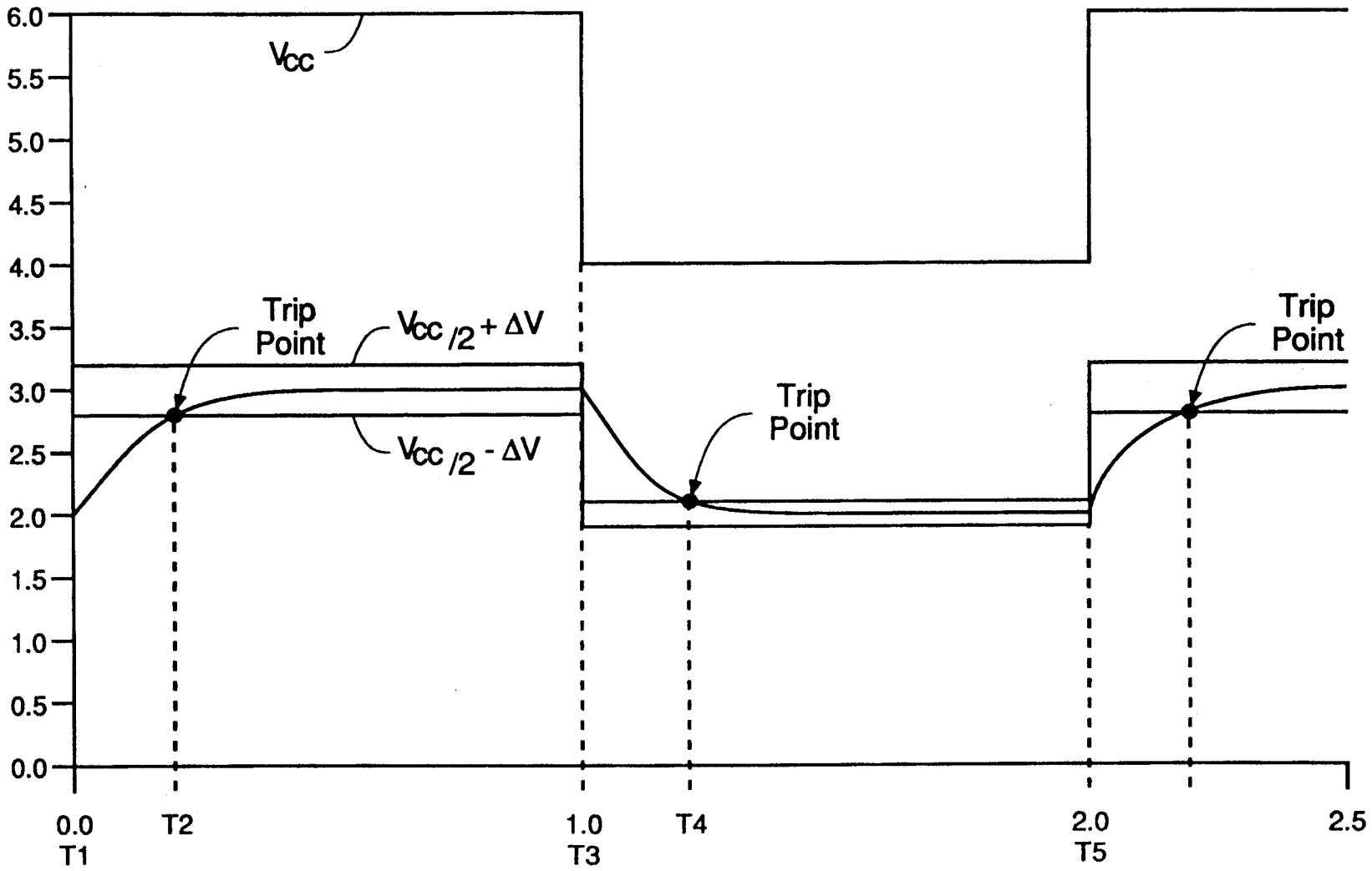
FIG. 5 illustrates the preferred embodiment circuit's response to $V_{cc}$ transitions based on computer simulation.

FIG. 5 illustrates the quick response of $V_{OUT}$ to $V_{cc}$ transitions. For sake of illustration, in FIG. 5 $V_{cc}$ transitions from a low level of 4V to a high level of 6V. $V_{cc}/2$ corresponds to a low level of 2V and a high level of 3V according to the low and high levels of $V_{cc}$ transitions previously mentioned. Differential voltage (delta-V) is defined as the voltage difference between the positive and negative inputs of U1 and U2 and in this discussion will be assumed to be 0.2V. Delta-V is required to trip op-amps U1 and U2 causing one or the other or both to drive their respective outputs to the corresponding negative or positive level.

At time T0, $V_{cc}$ is steady at 4V with $V_{OUT}$ stabilized at approximately 2V and the circuit is operating in the condition 2 mode described earlier. At time T1, $V_{cc}$ undergoes a transition from 4V to 6V causing reference voltages V1 and V2 to follow $V_{cc}$ in the positive direction. Since V1 is already at a higher potential than $V_{OUT}$, U2 remains in its previous state by maintaining a negative level at its output. However, as V2 rises above $V_{OUT}$ it will cause U1 to switch its output from a positive level to a negative level once the delta-V trip point is overcome, as shown at time T2. The circuit is now operating in the condition 1 mode until $V_{OUT}$ once again stabilizes between reference voltages V1 and V2 at approximately 3V causing it to operate in the condition 2 mode.

At time T3, $V_{cc}$ undergoes a transition from 6V to 4V causing V1 and V2 to follow $V_{cc}$ in the negative direction. Since V2 is already at a lower potential than $V_{OUT}$, U1 remains in its previous state by maintaining a positive level at its output. However, as V1 decreases below $V_{OUT}$, it will force U2 to switch its output from a negative level to a positive level once the delta-V trip point is overcome, as shown at time T4. The circuit is now operating in the condition 3 mode until $V_{OUT}$ once again stabilizes between V1 and V2 at approximately 2V, causing it to operate back in the condition 2 mode.

The circuit responds in the same manner previously described when $V_{cc}$ drops below 4V or goes above 6V because reference voltages V1 and V2 adjust relative to $V_{cc}$ levels and again the same scenario for adjusting $V_{OUT}$ happens from condition through 3 with all levels adjusted appropriately. Also, $V_{OUT}$ is adjusted accordingly to the previously described operation whether the transition occurs on $V_{ss}$ instead of $V_{cc}$ or both.

By using small devices to make up op-amps U1 and U2, the current drawn by these devices is relatively small (typically in the order of 5uA) and allows them to respond to power supply transitions at a very fast rate. The circuit of the preferred embodiment, responds to supply transitions in the order of 50 to 100nS, which is fast compared to prior methods that respond to supply transitions in the order of 70 to 200uS. Since power supply transitions typically occur at the rate of 5uS the speed advantage of the preferred embodiment circuit is self evident.

Clearly, other modifications may be made to the inventive circuit without escaping circumscription by the claims that follow.

We claim:

1. A circuit to generate an intermediate potential, comprising:

a first potential supply source;

a second potential supply source;

a first resistance having first and second nodes with said first node coupled to said first source;

a second resistance having first and second nodes with said first node of said second resistance coupled to said second node of said first resistance;

a third resistance having first and second nodes with said first node of said third resistance coupled to second node of said second resistance and with said second node of said third resistance coupled to said second supply;

a first amplifier having positive and negative inputs and an output with said negative input of said first amplifier coupled to said second node of said first resistance and to said first node of said second resistance;

a second amplifier having positive and negative inputs and an output with said negative input of said second amplifier coupled to said second node of said second resistance and to said first node of said third resistance and with said positive inputs of said first and second amplifiers coupled together;

a first PMOS transistor having first and second nodes and a gate with said first node of said first PMOS transistor coupled to said first supply and with said gate of said first PMOS transistor coupled to said output of said first amplifier;

a first NMOS transistor having first and second nodes and a gate with said first node of said first NMOS transistor coupled to said second node of said first PMOS transistor, with said second node of said first NMOS transistor coupled to said second supply and with said gate of said first NMOS transistor coupled to said output of said second amplifier;

a first inverter having input and output nodes with said output node coupled to said second node of said first PMOS transistor and to said first node of said first NMOS transistor;

a second inverter having input and output nodes with said input node of said second inverter coupled to said input node of said first inverter, to said second node of said first PMOS transistor and to said first node of said first NMOS transistor and with said output node of said second inverter coupled to said input node of said first inverter;

a second PMOS transistor having first and second nodes and a gate with said first node of said second PMOS transistor coupled to said first supply and with said gate of said second PMOS transistor coupled to said gate of said first PMOS transistor and to said output node of said first amplifier;

a third PMOS transistor having first and second nodes and a gate with said first node of said third PMOS transistor coupled to said second node of said second PMOS transistor, with said gate of said third PMOS transistor coupled to said output node of said second inverter and to said input node of said first inverter, and with said second node of said third PMOS transistor coupled to said positive input nodes of said first and second amplifiers and to an output node;

a second NMOS transistor having first and second nodes and a gate with said first node of said second NMOS transistor coupled to said second node of said third PMOS transistor, to said output node, to said positive input nodes of said first and second amplifiers and with said gate of said second NMOS transistor coupled to said output node of said second inverter, to said input node of said first inverter, and to said gate of said third PMOS transistor; and a third NMOS transistor having first and second nodes and a gate with said first node of said third NMOS transistor coupled to said second node of said second NMOS transistor, with said gate of said third NMOS transistor coupled to said gate of said first NMOS transistor and to said output of said second amplifier and with said second node of said third NMOS transistor coupled to said second supply.

2. A circuit to generate an intermediate potential, comprising:

a first potential supply source;

a second potential supply source;

a voltage divider network having first, second, third and fourth nodes with said first node coupled to said first source, with said fourth node coupled to said second source;

a first amplifier having first, second and third nodes with said first node of said first amplifier coupled to said second node of said network;

a second amplifier having first, second and third nodes with said first node of said second amplifier coupled to said third node of said network and with said second nodes of said first and second amplifiers coupled together;

a first switch having first, second and third nodes with said first node of said first switch coupled to said first supply and with said third node of said first switch coupled to said third node of said first amplifier;

a second switch having first, second and third nodes with said first node of said second switch coupled to said second node of said first switch, with said second node of said second switch coupled to said second supply and with said third node of said second switch coupled to said third node of said second amplifier;

a latch network having first and second nodes with said first node coupled to said second node of said first switch and to said first node of said second switch;

a third switch having first, second and third nodes with said first node of said third switch coupled to said first supply and with said third node of said third switch coupled to said third node of said first switch and to said second node of said first amplifier;

a fourth switch having first, second and third nodes with said first node of said fourth switch coupled to said second node of said third switch, with said third node of said fourth switch coupled to said second node of said latch network and with said second node of said fourth switch coupled to said second nodes of said first and second amplifiers and to an output node;

a fifth switch having first, second and third nodes with said first node of said fifth switch coupled to said second node of said fourth switch, to said output node, to said second nodes of said first and second amplifiers and with said third node of said fifth switch coupled to said second node of said latch network and to said third node of said fourth switch; and a sixth switch having first, second and third nodes with said first node of said sixth switch coupled to said second node of said fifth switch, with said third node of said sixth switch coupled to said third node of said second switch and to said second node of said second amplifier and with said second node of said sixth switch coupled to said second supply.

* * * * *

UNITED STATES PATENT AND TRADEMARK OFFICE

CERTIFICATE OF CORRECTION

PATENT NO. : 5,027,053

DATED : June 25, 1991

INVENTOR(S) : Kul B. Ohri et al

It is certified that error appears in the above-identified patent and that said Letters Patent is hereby corrected as shown below:

Column 1, line 37, delete "$V_{22}$"and insert -- $V_{ss}$--;

Column 3, line 54, delete "is" and insert -- cannot be --;

Signed and Sealed this

Seventh Day of December, 1993

*Attest:*

*Attesting Officer*

Bruce Lehman

BRUCE LEHMAN

*Commissioner of Patents and Trademarks*